United States Patent [19]

Bussan et al.

[11] Patent Number: 4,936,641

[45] Date of Patent: Jun. 26, 1990

[54] MOUNTING SYSTEM FOR AN ADJUSTABLE REFRIGERATOR ARTICLE SUPPORTING MEMBER

[75] Inventors: Marc R. Bussan, Evansville; Charles G. Fellwock, Scott Township, Vanderburgh County, both of Ind.; Charles C. Burger, Lincoln Township, Berrien County, Mich.

[73] Assignee: Whirlpool Corporation, Benton Harbor, Mich.

[21] Appl. No.: 268,296

[22] Filed: Nov. 7, 1988

[51] Int. Cl.[5] ..... A47B 81/00

[52] U.S. Cl. ..... 312/214; 211/74; 211/134; 211/187; 312/350

[58] Field of Search ..... 248/222.2, 222.3, 235, 248/239; 211/134, 187, 74; 312/214, 350

[56] References Cited

U.S. PATENT DOCUMENTS

| | | | |
|---|---|---|---|
| 682,035 | 9/1901 | Coffin | 248/243 |
| 1,504,523 | 8/1924 | Sherer | 248/222.2 X |
| 2,682,754 | 7/1954 | Eck | 312/350 |
| 3,984,163 | 10/1976 | Boorman et al. | 312/350 X |
| 4,152,034 | 5/1979 | Dunning | 248/239 X |
| 4,365,562 | 12/1982 | Webb | 108/108 |

*Primary Examiner*—Joseph Falk

*Attorney, Agent, or Firm*—Mason, Kolehmainen, Rathhburn & Wyss

[57] ABSTRACT

A mounting system for an article supporting member in a refrigerator includes first and second support members each of which is removably secured to a respective pair of studs mounted on opposite sidewalls of the liner of a refrigerator compartment so that the height of the support members masy be adjusted. Each of the first and second support members includes a track for receiving opposite sides of a refrigerator shelf or storage bin for slidable movement therein. The track of the first support member permits lateral movement of the refrigerator shelf; whereas the track of the second support member substantially prevents lateral movement of the refrigerator shelf to accommodate dimensional variations in the liner of the refrigerator compartment. Each of the studs is a dovetail stud having a rounded upper and lower edge so as to permit a support member to be pivoted about one stud when mounting the support member to the refrigerator compartment liner. Each support member may have a single track or double tracks wherein the double tracks receive both a refrigerator shelf and a storage bin. Further, a wine rack may be mounted on a pair of studs in the same manner as a support member.

34 Claims, 6 Drawing Sheets

MOUNTING SYSTEM FOR AN ADJUSTABLE REFRIGERATOR ARTICLE SUPPORTING MEMBER

BACKGROUND OF THE INVENTION

1. Field of the Invention

The present invention relates to a mounting system for an adjustable article supporting member in a refrigerator, and more particularly to such a system that includes first and second adjustable support members, mounted on opposite sides of a refrigerator compartment, each support member having a track for slidably receiving a side of a refrigerator shelf or a side of a storage bin therein; wherein, the track of the first support member permits lateral movement of the refrigerator shelf or storage bin and the track of the second support member substantially prevents lateral movement of the refrigerator shelf or storage bin so as to securely support the refrigerator shelf or storage bin and allow the shelf or bin to be pulled out smoothly by accommodating dimensional variations in the refrigerator compartment.

2. Description of the Prior Art

Mounting systems for adjustable refrigerator shelves are known to include elongated support members mounted, for example, on the rear wall of the refrigerator compartment liner, wherein, each support member includes a number of vertically aligned slots. Hooks extending from the rear of a refrigerator shelf are inserted into horizontally aligned slots of two support members to removably secure the refrigerator shelf in the refrigerator compartment. A similar refrigerator shelf mounting system is shown in U.S. Pat. No. 4,365,152 vertically elongated tracks having an S-shaped cross-section abut the rear wall of a refrigerator compartment while being secured to a sidewall thereof. The tracks include a number of slots for receiving a hook extending from a bracket secured to a refrigerator shelf to mount the refrigerator shelf in the refrigerator compartment. Although this type of mounting system allows a refrigerator shelf to be mounted at various heights within the refrigerator compartment, the refrigerator shelf cannot be pulled out. Because the refrigerator shelf cannot be pulled out, articles located at the rear of the refrigerator shelf may be difficult to reach.

U.S. Pat. No. 682,035 shows a refrigerator shelf support system that includes a pair of rear upright supports having a series of slots therein, the rear upright supports being mounted on a rear wall of a refrigerator compartment. A pair of front upright supports are mounted on a front wall of the refrigerator compartment, the front upright supports also having a series of slots therein. Horizontally extending shelf supports are provided with a flange at the front and rear thereof for insertion into respective slots in the front and rear upright supports. Each of the shelf supports includes a track into which a side of a refrigerator shelf is inserted so as to mount the refrigerator shelf in the refrigerator compartment. As shown therein, the refrigerator shelf fits snugly in each track of the shelf supports so as to prevent lateral movement of the shelf.

Liners of refrigerator compartments are now typically formed of plastic so that dimensional variations in the refrigerator compartment, such as the width of the compartment, must be accounted for when mounting refrigerator shelves therein. The dimensional variations of the refrigerator compartment liner typically do not become apparent until operation of the refrigerator making it difficult to provide a refrigerator shelf mounting system that provides positive support and allows a refrigerator shelf to be smoothly pulled out.

SUMMARY OF THE INVENTION

In accordance with the present invention, the disadvantages of refrigerator shelf mounting systems as discussed above, have been overcome. The mounting system of the present invention includes first and second support members each of which is removably secured to a respective pair of studs mounted on opposite sidewalls of the liner of a refrigerator compartment so that the height of the support members may be adjusted. Each of the first and second support members includes at least one track wherein the tracks receive opposite sides of a refrigerator shelf or storage bin for slidable movement therein. The track of the first support member permits lateral movement of the refrigerator shelf or storage bin; whereas, the track of the second support member substantially prevents lateral movement of the refrigerator shelf or storage bin to positively support the refrigerator shelf or storage bin in the refrigerator compartment and to allow the refrigerator shelf or storage bin to be pulled out smoothly by accommodating dimensional variations in the liner of the refrigerator compartment.

More particularly, the mounting systems of the present invention includes a first pair of horizontally aligned studs mounted on a first sidewall of the refrigerator compartment liner with one stud being positioned toward the rear of the refrigerator compartment and the other stud being positioned towards the front of the refrigerator compartment. A second pair of horizontally aligned studs are mounted on a second sidewall of the refrigerator compartment liner at the same height as the first pair of studs wherein the second pair of studs similarly includes a rearwardly positioned stud and a forwardly positioned stud. A first support member has an elongated sidewall with a rearwardly positioned slot and a forwardly positioned slot formed in the backside of the sidewall to respectively engage a rearwardly and forwardly positioned stud of the first pair of studs. The first support member also includes an upper flange extending generally horizontally from a front side of the support member's sidewall along the length thereof and a lower flange that extends generally horizontally from the front side of the sidewall along the length thereof and spaced a distance below the upper flange to form a track therebetween. A second support member is similarly provided with a rearwardly positioned slot and a forwardly positioned slot formed in the backside of the sidewall of the support member wherein the forwardly and rearwardly positioned slots respectively engage the forwardly and rearwardly positioned studs of the second pair of studs. The second support member further includes an upper flange and a spaced lower flange to form a track therebetween wherein one or more projections extends upwardly from an outer edge of the lower flange.

The tracks of the first and second support members receive opposite sides of a refrigerator shelf or storage bin to slidably mount the refrigerator shelf or storage bin in the refrigerator compartment. More particularly, the tracks receive opposite sides of a picture frame extending about the periphery of the refrigerator shelf or opposite sides of a rim framing the upper surface of a storage bin. The projection(s) extending upwardly from the lower flange of the second support member abuts the inner surface of the refrigerator shelf frame or storage bin rim received in the track of the second support member to substantially prevent lateral movement of the refrigerator shelf frame or storage bin rim received therein. The first support member, however, permits lateral movement of the opposite side of the refrigerator shelf frame or storage bin rim so as to accommodate dimensional variations in the liner of the refrigerator compartment.

The rearwardly positioned slot of each support member is U-shaped, opening towards the rear end of the support member and extending forwardly therefrom. The forwardly positioned slot of each shelf support member is also U-shaped. However, the forwardly positioned slot opens from a lower edge of the support member and extends upwardly therefrom. To mount the shelf support member on a sidewall of the refrigerator compartment liner, the support member is moved rearwardly along the wall of the liner at an angle such that the front end of the support member is above the rear end thereof until the rearward slot of the shelf support member engages a rearwardly positioned stud mounted on a sidewall of the refrigerator compartment liner. Thereafter, the shelf support member is pivoted about the rearwardly positioned stud, moving the front end of the support member downward until the forwardly positioned slot engages the forwardly positioned stud mounted in the refrigerator compartment liner. This method of mounting a shelf support member in the refrigerator compartment substantially prevents accidental disengagement of the shelf support member during normal use of the shelf.

Each of the studs is a dovetail stud; whereas each of the slots in the support members is a dovetail slot. Each slot engages a stud, on three sides thereof to make a strong joint. Further, each stud has a rounded upper and lower edge so as to permit a shelf support member to be pivoted about a stud.

A first double track support member and a second double track support member are further provided to support a refrigerator shelf as discussed above and to further support a storage bin or the like beneath the refrigerator shelf. More particularly, the sidewall of each double track support member includes four flanges extending generally horizontally from a first side of the sidewall. The two uppermost flanges of the first and second double track support members are formed in the same manner as the upper flange and lower flanges of the respective first and second single track support members described above to provide upper tracks for supporting a refrigerator shelf. The two lowest flanges extending from the sidewall of each double track support members form a lower track in which a side of an upper rim of a storage bin is slidably received. The lowest flange of the second support member is formed with one or more projections extending upwardly from an outer edge thereof, so as to prevent lateral movement of the side of the storage bin rim received therein. The lower track of the second double track support member, however, permits lateral movement of the opposite side of the storage bin rim received therein to accommodate dimensional variations in the refrigerator compartment liner. Each double track support member includes a rearwardly and forwardly positioned slots in the backside of its sidewall wherein the slots are the same as those formed in the single track support members so as to enable a double track support member to be mounted in the same manner as the single track support member.

A wine rack is further provided which may be mounted on the forwardly and rearwardly positioned studs of a sidewall of the refrigerator compartment liner. The wine rack includes an elongated side flange that extends downwardly into a side of an elongated bottle support member having a generally U-shaped cross-section, the side flange and bottle support member being integrally formed. Generally U-shaped dovetailed slots are formed on the backside of the side flange of the wine rack at a rearward position and a forward position. The rearwardly position slot opens towards the rear of the side flange whereas the forwardly positioned slot opens downwardly in the same manner as the slots formed in the backside of the single track shelf support members discussed above. The slots allow the wine rack to be mounted by moving the wine rack rearwardly along a wall of the refrigerator compartment liner and at an angle with the front end of the wine rack above the rear end thereof until the rearwardly positioned slot engages a rearwardly positioned stud mounted on the liner sidewall. Thereafter, the wine rack is pivoted downward about the rearwardly positioned slot until the forwardly positioned slot engages a forwardly positioned stud to secure the wine rack to a sidewall of the refrigerator compartment liner.

These and other objects, advantages and novel features of the present invention, as well as details of an illustrated embodiment thereof, will be more fully understood from the following description and the drawing.

DESCRIPTION OF THE PREFERRED EMBODIMENT

Figure 1:
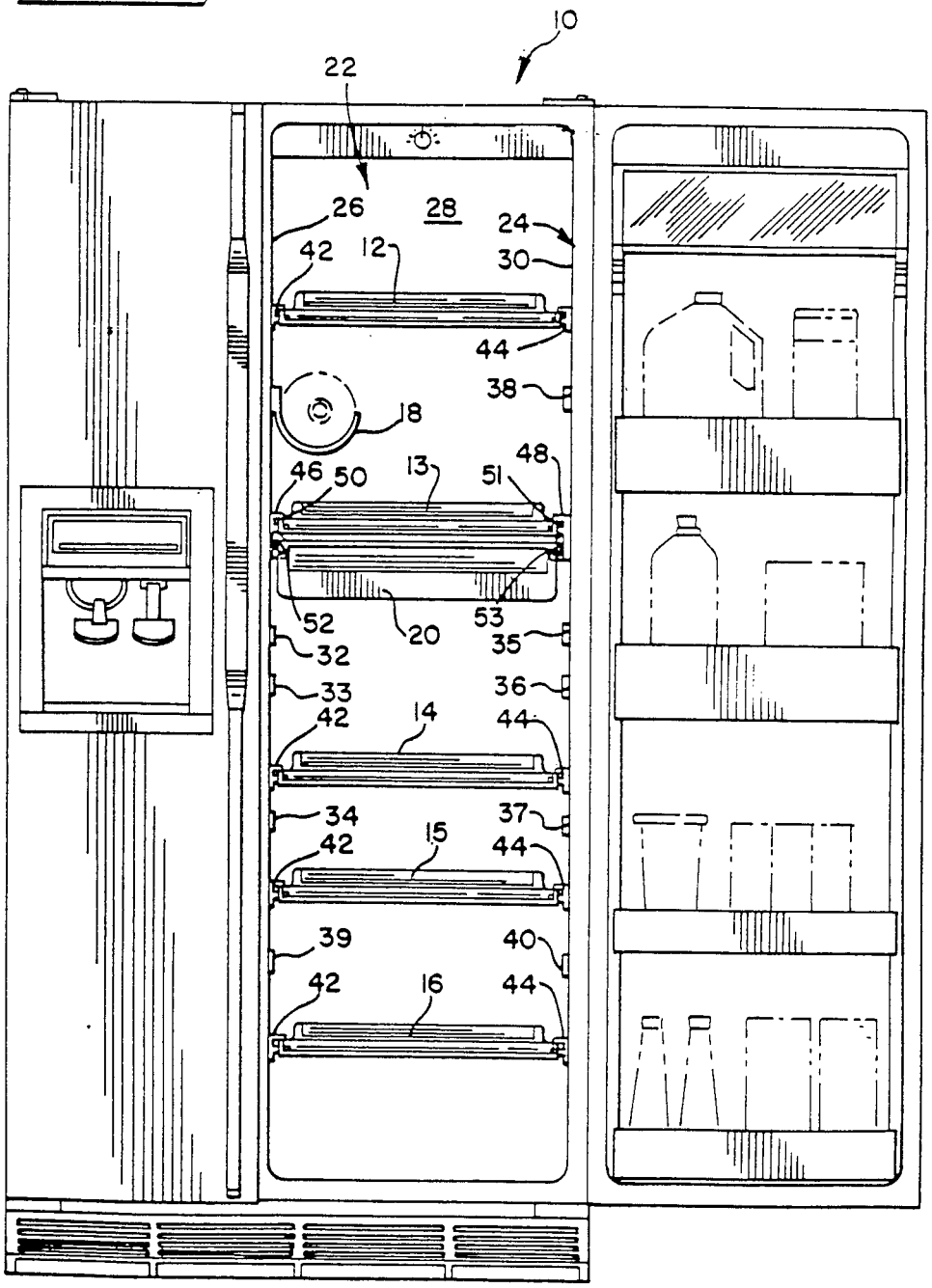
FIG. 1 is a perspective view of a refrigerator incorporating the mounting system for article supporting members of the present invention.

The mounting system of the present invention for adjustable refrigerator shelves 12–16, a wine rack 18 and storage bin 20 is shown in FIG. 1 for a refrigerator 10. The refrigerator 10 includes a refrigerator compartment 22 having a plastic liner 24 therein forming a left sidewall 26, a rear wall 28, and a right sidewall 30 of the compartment 22. Pairs of horizontally aligned studs, only one stud 32–40 of each pair being shown in FIG. 1, are mounted in the left and right sidewalls 26 and 30 of the liner 24 to secure respective left and right single track support members 42 and 44 and left and right double track support members 46 and 48 to the liner sidewalls 26 and 30. The single track support members 42 and 44 slidably mount a refrigerator shelf 12, 14–16 therein; whereas, the double track support members 46 and 48 slidably mount a shelf 13 in an upper track 50, 51 thereof and slidably mount a storage bin 20 in a lower track 52, 53 thereof. The single track support members 42 and 44 and the double track support members 46 and 48 may be mounted on studs at various heights to adjust the height of the shelves 12–16 and storage bin 20. The pairs of studs including the 32, 33, 34 and 39 mounted in the left sidewall 26 of the liner 24 may further be used to secure the wine rack 18 to the liner sidewall 26 as discussed in detail below.

Each of the single and double track support members 42, 44, 46 and 48 includes an elongated sidewall such as the sidewall 54 shown in FIGS. 2, 3, 6 and 8 for the left single track support member 42. On the backside 56 of the sidewall 54 are a pair of slots including a forwardly positioned slot 58 and a rearwardly positioned slot 60. The rearwardly positioned slot 60 is a dovetailed slot having a U-shaped configuration that opens towards the rear end 62 of the left single track support member 42. The slot 60 extends from the rear end 62 forward, towards the front end 63 of the left single track support member 42. The slot 58 is a dovetailed slot with a U-shaped configuration that opens towards the lower edge 64 of the left single track support member 42. The slot 58 extends from the lower edge 64 of the support member 42 upwardly.

Figure 4:
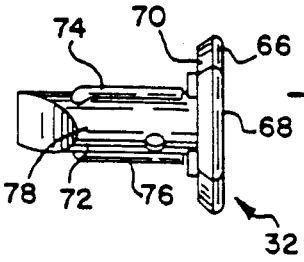
FIG. 4 is a front view of a dovetail stud shown in FIGS. 1–3.
Figure 5:
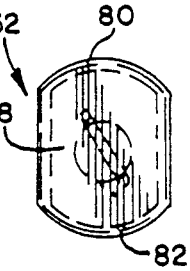
FIG. 5 is a side view of the stud shown in FIG. 4.
Figure 6:
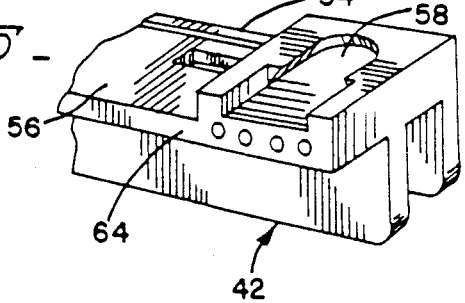
FIG. 6 is a partial perspective view of the backside of a left support member illustrating a forwardly positioned slot.

Each of the studs 32–40 is a dovetailed stud as shown in detail in FIGS. 4 and 5. Each stud 32–40 includes a dovetailed head 66 having a front face 68 and rear face 70. Extending from the rear face 70 is a centrally located shaft 72 to which metal wires 74 and 76 are attached on opposite sides of the shaft 72 near an end 78 thereof. When a stud, such as the stud 32 is secured to the liner 24 of the refrigerator compartment 22, the metal wires 74 and 76 angle away from the shaft 72 near the head 68 of the stud 32 so as to retain the stud 32 secured to the liner 24. When installed in the liner 24, the studs 32–40 project approximately one-eighth of an inch from the sidewall 26, 30 of the refrigerator compartment liner 24. Further, the head 68 of the each of the studs has a rounded upper edge 80 and a rounded lower edge 82 so as to permit a shelf support member 42, 44, 46, 48 and the wine rack 18 to be pivoted about a stud as described in detail below.

Figure 2:
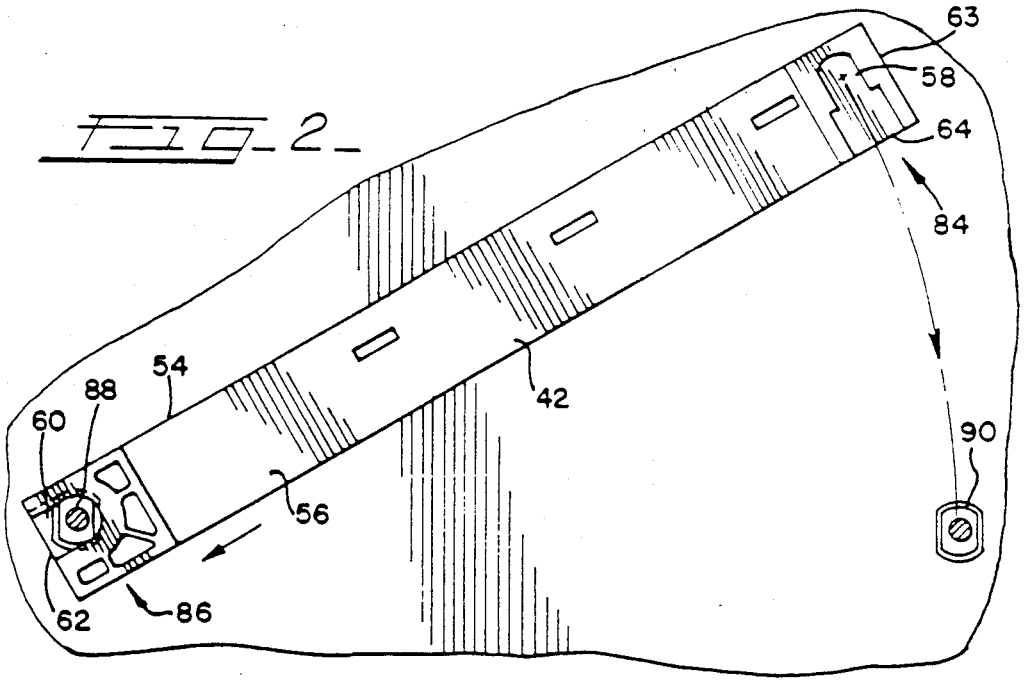
FIG. 2 is an inside elevation illustrating a left support member secured to a rearwardly positioned stud and at an angle with respect to the forwardly positioned stud.
Figure 3:
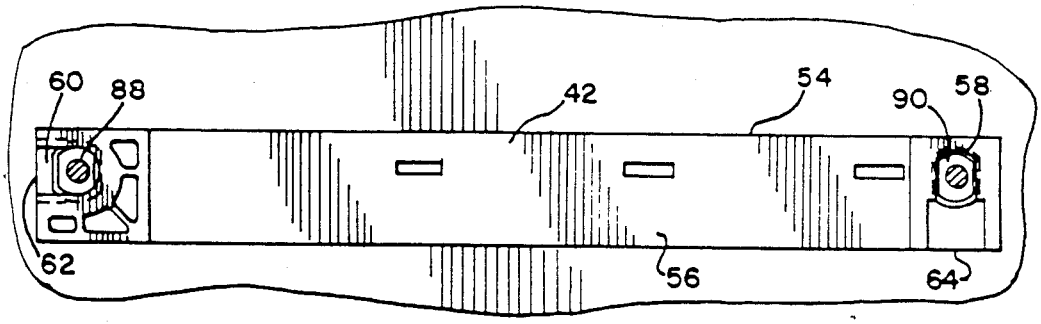
FIG. 3 is an inside elevation showing a left support member mounted on a rearwardly and forwardly positioned stud.

To mount a shelf support member 42, 44, 46 and 48 on a sidewall 26, 30 of the refrigerator compartment liner 24, as shown in FIGS. 2 and 3 for the left single track support member 42, the support member 42 is moved rearward along the sidewall 26 of the liner 24 at an angle such that the front end 84 of the support member 42 is above the rear end 86 of the support member 42. The support member 42 is moved rearwardly as such until the rearward slot 60 engages the rearward stud 88 mounted on the sidewall 26 of the refrigerator compartment liner 24 near the rear of the compartment 22. Thereafter, the shelf support member 42 is pivoted about the rear stud 88, moving the front end 84 of the support member 42 downward until the front slot 58 engages a front stud 90 mounted at a forward position in the sidewall 26 of the refrigerator compartment liner 24. This method of mounting a shelf support member in the refrigerator compartment substantially prevents accidental disengagement of the shelf support member during normal use of the shelf. When the support member 42 is mounted as such on the studs 88 and 90, the slots 60 and 58 respectively engage the studs 88 and 90 on three sides of the stud so as to provide a strong joint.

Figure 7:
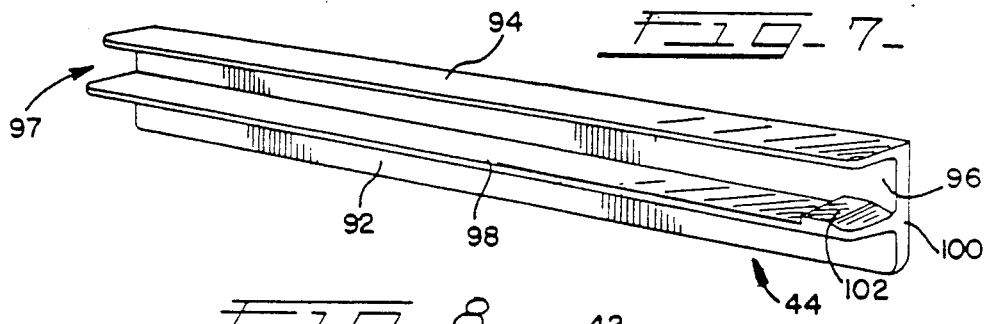
FIG. 7 is a perspective view of a right single track support member.
Figure 8:
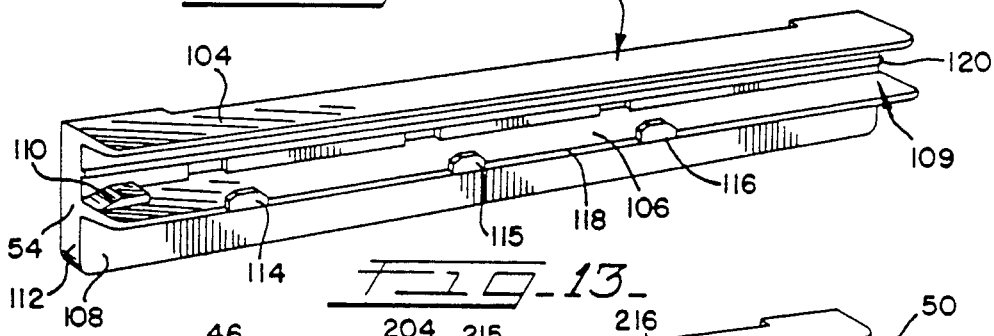
FIG. 8 is a perspective view of a left single track support member.

As shown in FIG. 7, the right single track support member 44 has an elongated sidewall 92. The back-side of the sidewall 92 of the right single track support member 44 is substantially a mirror image of the back-side 56 of the sidewall 54 of the left single track support member 42 with forwardly and rearwardly positioned slots so as to enable the right support member to be mounted on the right sidewall 30 of the liner 24 in the same manner as described above for the left support member 42. An upper flange 94 extends generally horizontally along the length of the support member 44 from a front side 96 of the right support member's sidewall 92. A lower flange 98 extends generally horizontally along the length of the support member 44 from the front side 96 of the sidewall 92 but spaced a distance below the upper flange 94 so as to form a track 97 between the upper and lower flanges 94 and 98. At a forward end 100 of the right single track support member 44, a projection 102 is formed on the lower flange 98, the projection 102 extending upwardly from the lower flange 98 so as to provide a stop for a refrigerator shelf 12, 14–16 as described below.

The left single track support member 42 is similar to the right single track support member 44 in that a generally horizontally extending upper flange 104 and a generally horizontally extending lower flange 106, that is spaced a distance below the upper flange 104, extend from a front side 108 of the sidewall 54 of the left single track support member 42 to form a track 109 between the upper and lower flanges 104 and 106. The lower flange 106 also includes an upwardly extending projection 110 disposed at a forward end 112 of the left single track support member 42 so as to provide a stop for a refrigerator shelf supported therein. The left single track support member 42 differs from the right single track member 44 in that a series of projections 114–116 extend upwardly from an outer edge 118 of the lower flange 106. Further, a small rib 120 is formed on the front face 108 of the left single track support member's sidewall 54 between the upper flange 104 and the lower flange 106 wherein the rib 120 extends the length of the track 109. The upwardly extending projections 114–116 and the rib 120 substantially prevent lateral movement of a refrigerator shelf 12, 14–16 by providing a snug fit therein for the left side 186 of a picture frame 124 of the shelf 12, 14–16 as will be apparent from the description below.

Figure 9:
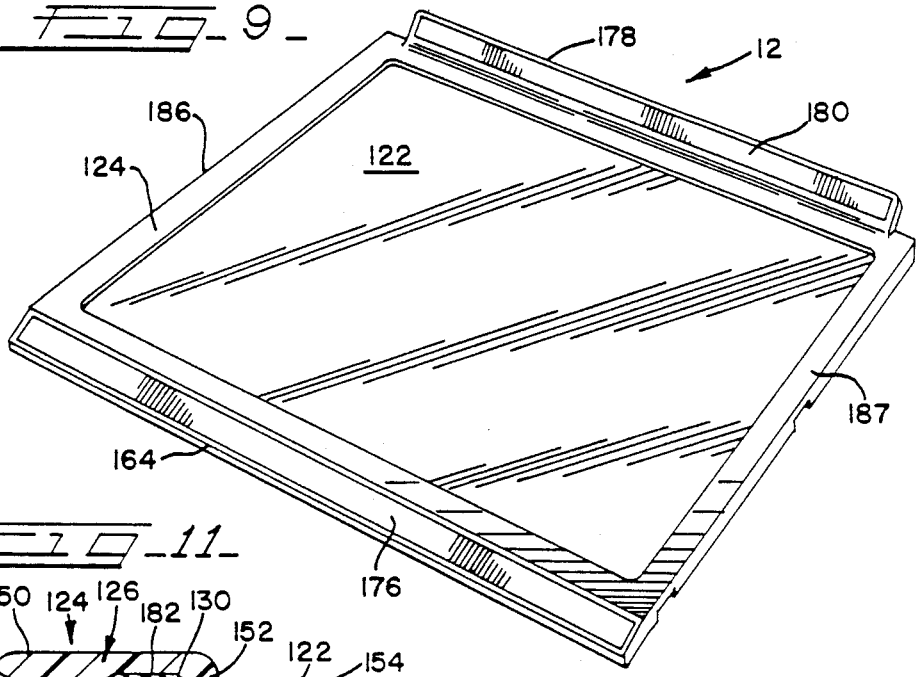
FIG. 9 is a perspective view of a refrigerator shelf as shown in FIG. 1.
Figure 11:
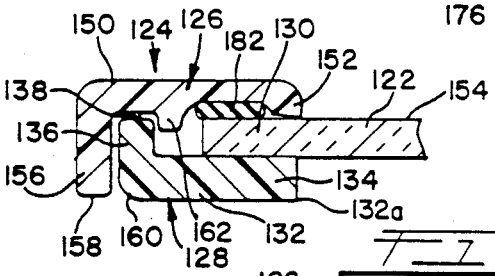
FIG. 11 is a cross-sectional view taken along lines 11—11 of FIG. 9.
Figure 10:
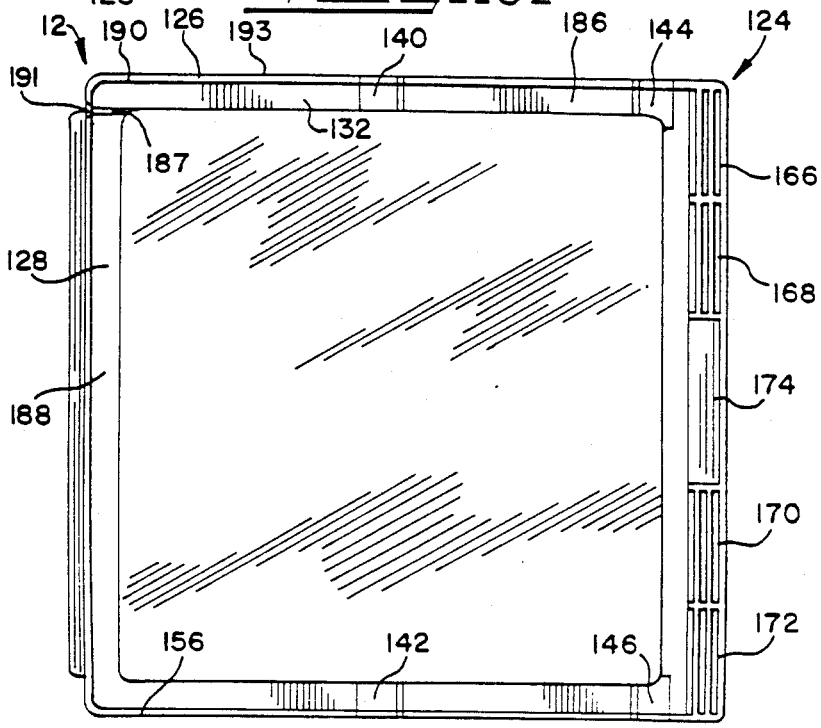
FIG. 10 is a bottom view of the refrigerator shelf shown in FIG. 9.
Figure 15:
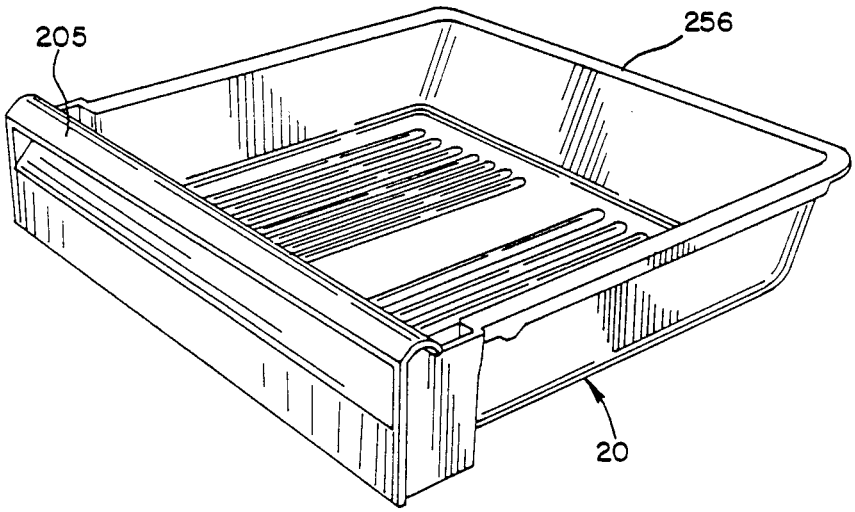
FIG. 15 is a perspective view of a storage bin as shown in FIG. 1.

As shown in FIGS. 9–11 for the refrigerator shelf 12, each of the refrigerator shelves 12–16 includes a plate 122 of tempered glass for supporting articles thereon and a rectangular plastic picture frame 124 that extends about the entire periphery of the glass plate 122. The picture frame 124 includes an upper frame 126 and a lower frame 128 that are ultrasonically welded together so that the frames 126 and 128 sandwich a peripheral edge 130 of the glass plate 122 therebetween. Details of the shelves 12-16 are provided below and in the copending U.S. patent application Serial No. 07/267,815 filed on Nov. 7, 1988.

The lower frame 128 includes a generally horizontally extending frame member 132 that extends beneath the periphery 130 of the glass plate 122 and a portion 134 of which, abuts the glass plate 122. A flange 136 extends upwardly from an outer surface of the frame member 132 a distance approximately equal to the thickness of the glass plate 122. A smaller flange 138 projects upwardly from the flange 136 for ultrasonically welding the lower frame 128 and the upper frame 126 together. As shown in FIG. 10, the lower frame 128 is formed with indentations 140, 142, 144 and 146 on the underside thereof. The indentations 140 and 144 cooperate with the stop 110 formed on the left single track support member 42; whereas, the indentations 142 and 146 cooperate with the stop 102 formed on the single track right support member 44 so that the refrigerator shelf 12 may not be inadvertently pulled out.

The upper frame 126 of the picture frame 124 includes a generally horizontally extending frame member 150 that extends above the periphery of the glass plate 122. A flange 152 extends downwardly from an inner surface of the frame member 150 so as to abut the upper surface 154 of the glass plate 122 about its entire periphery when the upper and lower frames 126 and 128 are secured together. The frame member 150 further includes a flange 156 that extends downwardly from an outer surface of the frame member 150. The flange 156 extends downwardly a sufficient distance such that the bottom surface 158 thereof is slightly above the bottom surface 160 of the frame member 132 of the lower frame 128 when the upper and lower frames 126 and 128 are secured together so that the lower frame 128 carries the load. A flange 162 extends downwardly from a mid portion of the frame member 150 at a distance from the flange 156 so as to accommodate the upwardly extending flange 136 of the lower frame 128. The flanges 156 and 162 aid in aligning the upper and lower frames 126 and 128 during the assembly of the refrigerator shelf.

The upper frame 126 further includes an integrally formed flange 164 that extends at a slight downward angle from the front of the picture frame 124. As shown in FIG. 10, the flange 164 has four sets of ribs 166, 168, 170 and 172 with a centrally disposed gripping area 174 so that the refrigerator shelf 12 may be easily pulled out. If desired, a decorative trim such as an aluminum strip 176 may be adhesively bonded to the front face of the flange 164. An integrally formed flange 178 further extends upwardly at a slight rearward angle from the rear of the upper frame 126. A reflector 180 such as an aluminum strip is secured to a front face of the flange 178 for decorative effect.

To ensure that a liquid spilled onto the glass plate 122 does not seep between the glass plate 122 and the upper frame 126, a silicon seal 182 is provided between the frame member 150 and the glass plate 122, abutting the flange 152. The silicon seal 182 may be in the form of a solid gasket extending about the entire periphery of the glass plate 122. Alternatively, the silicon seal 182 may be applied between the glass plate 122 and the upper frame 126 in liquid form.

When a left single track support member 42 and a right single track support member 44 are mounted at the same height on the liner sidewalls 26 and 30 of the refrigerator 10 as discussed above, a refrigerator shelf 12, 14–16 may be mounted in the refrigerator compartment 22 by sliding the refrigerator shelf 12, 14–16 into the tracks 97 and 109 formed in the right single track support member 44 and the left single track support member 42. More particularly, the refrigerator shelf 12, 14–16 is slid onto the support members 42 and 44 such that the left side 186 of the frame 124 of the refrigerator shelf 12 is positioned in the track 109 between the sidewall 54 and the upwardly extending projections 114–116 with the projections 114–116 abutting the edge surface **132*a* of the frame member 132 (FIG. 11) and the rib 120 abutting the flange 156. As shown in FIG. 10, a slot 187 is formed at the rear 188 of the lower frame 128 in the frame member 132, parallel to the left edge 190 of the lower frame 128 and at a distance from the edge 190 equal to the width of the frame member 132. Similarly, a slot 191 is formed in the flange 156 of the upper frame 126 at the rear thereof and spaced a distance from the left edge 193 of the upper frame 126 equal to the width of the flange 132 plus the width of the flange 156 so as to align the slot 191 with the slot 187 when the upper and lower frames are secured together. As the refrigerator shelf 12 is slid between the tracks of the left single track support member 42 and the right single track support member 44, the projections 114–116 slide through the slot 187 to permit the refrigerator shelf 12 to be mounted in the refrigerator compartment 22. The refrigerator shelf is held in place in the refrigerator compartment 22 by the stops 110 and 102 which respectively engage the indentations 144 and 146 formed on the lower frame 128 of the picture frame 124 of the refrigerator shelf 12. When mounted as such in the refrigerator compartment 22, the refrigerator shelf 12, 14–16 fits snugly in the left support member 42 while being able to move laterally in the track 97 of the right support member 44 so as to accommodate dimensional variations in the refrigerator compartment liner 24 and enable the shelf 12, 14–16** to be pulled out smoothly.

To pull the refrigerator shelf 12, 14–16 out, the refrigerator shelf 12, 14–16 is lifted slightly upwardly to disengage the stops 110 and 102 from the respective indentations 144 and 146. The shelf 12, 14–16 then is slid forward until the stops 110 and 102 engage the indentations 140 and 142. If it is desired to completely remove the shelf 12, the shelf is again lifted slightly upwardly and pulled forward so that the stops 110 and 102 disengage the indentations 140 and 142.

Figure 13:
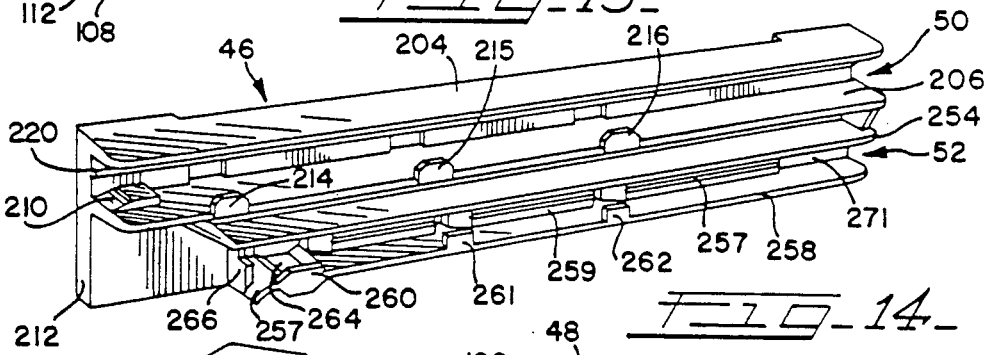
FIG. 13 is a perspective view of a left double track support member.
Figure 14:
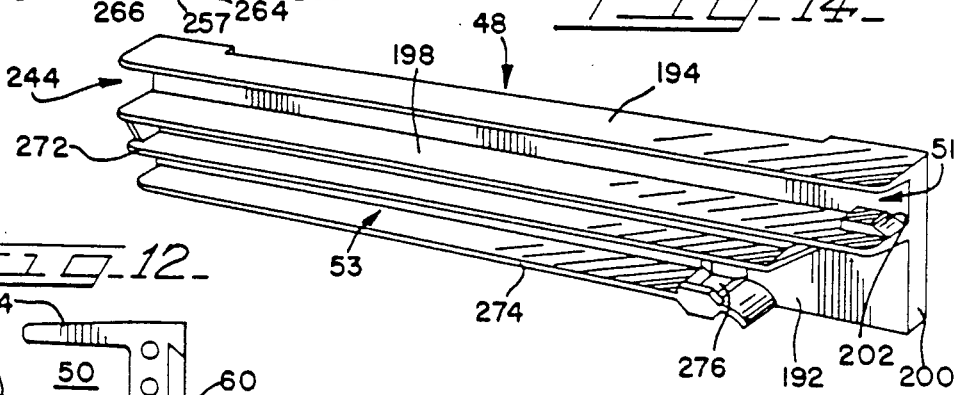
FIG. 14 is a perspective view of a right double track support member.
Figure 12:
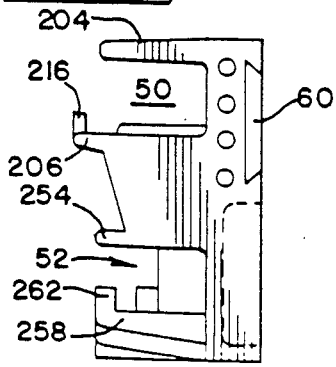
FIG. 12 is a rear end view of a left double track support member.

The double track support members 46 and 48 as shown in detail in FIGS. 12–14 support in upper tracks 50 and 51 a refrigerator shelf 13 having the same configuration as described above for the refrigerator shelf 12. Each of the double track support members 46 and 48 includes a lower track 52 and 53 to support a storage bin 20 therein. More particularly, the left double track support member 46 includes a sidewall 212 with an upper flange 204 extending the length thereof and a second flange 206 spaced from the upper flange 204 by a sufficient distance to accommodate the picture frame 124 of a refrigerator shelf 13 in the track 50. A stop 210 is formed on a front end of the second flange 206 so as to cooperate with the indentations 140 and 144 of the refrigerator shelf 13 as discussed above for the refrigerator shelf 12. The flange 206 further includes upwardly extending projections 214–216 extending from the outer edge of the flange 206. A small rib 220 extends outwardly from the sidewall 212 between the upper flange 204 and the second flange 206 so as to cooperate with the upwardly extending projections 214–216 to provide a snug fit for the left side 186 of the picture frame 124 of a refrigerator shelf 13 as discussed above for the left single track support member 42. A third flange 254 extends outwardly from the sidewall 212 of the double track support member 46, spaced below the second flange 206 so as to accommodate a front, curved gripping flange 205 that extends above the rim 256 of the storage bin 20. A lower flange 258 also extends outwardly from the sidewall 212 of the left double track support member 46 to form with the third flange 254 the lower track 52. The lower flange 258 has a downwardly curved lip 257 at its forward end so as to aid in mounting a storage bin 20 in the lower track 52. The lower flange 258 is also formed with upstanding projections 260–262 that extend upwardly from an outer edge of the flange 258. A horizontally extending lower track sidewall 259 parallels the sidewall 212 of the support member 46 but extends outwardly therefrom with a rib **259*a* extending the length of the lower track sidewall 259. The rib 259*a* and projections 260–262 provide a snug fit for the left side of the rim 256 of the storage bin 20 to substantially prevent lateral movement thereof. The lower flange 258 further includes an indentation 264 formed at a forward end 266 thereof. The indentation 264 cooperates with a stop 268 that extends downwardly from a downwardly extending flange 269 on the left side of the rim 265 formed on of the refrigerator bin 20. The stop 268 in cooperation with the indentation 264 prevents the refrigerator bin 20 from being inadvertently being pulled out of the lower track 52**.

The right double track support member 48 includes an upper flange 194 that extends outwardly from a sidewall 200 of the right double track support member 48. A second flange 198 also extends outwardly from the sidewall 200, the second flange 198 being spaced from the top flange 194 so as to accommodate the right side 187 of the picture frame 124 of the refrigerator shelf 13 in the upper track 51. A third flange 272 extends outwardly from the sidewall 200 of the right double track support member 48 wherein the third flange 272 is spaced from the second flange 198 by a distance so as to accommodate the gripping flange 205 of the storage bin 20. A lower flange 274 is also formed, extending outwardly from the sidewall 200 of the right double track support member 48 and spaced a distance from the third flange 272 so as to accommodate the rim 256 of the storage bin 20. The lower flange 274 includes an indentation 276 that cooperates with a stop 278 formed on the right side of the storage bin 20 wherein the stop 278 extends downwardly from a downwardly extending flange 281 of the rim 256. The stop 278 and indentation 276 cooperate so as to prevent the storage bin from inadvertently being pulled out of the lower track 53 formed between the third flange 272 and the lower flange 274.

Each of the left double track support members 46 and the right double track support members 48 includes in a backside of the respective sidewalls 200 and 212 of the supporting members 48 and 46 a rearward slot 60 and a forward slot 58 such as shown in FIGS. 2 and 3 for the left single track support member 42. The slots enable the double track support members 46 and 48 to be mounted on a pair of horizontally aligned studs 88 and 90 on the sidewall 26, 30 of the liner 24 in the same manner as discussed above for the left single track support member 42.

Once the double track support members 46 and 48 are mounted on the respective left sidewall 26 and the right sidewall 30 of the liner 24 of the refrigerator compartment 22, a refrigerator shelf 13 and a storage bin 20 may be mounted therein. The refrigerator shelf 13 is slid between the upper flange 204 and the second flange 206 in the track 50 of the left double track support member 46 and the upper flange 194 and the second flange 198 in the track 51 of the right double track support member 48 in the same manner as discussed above with respect to the refrigerator shelf 12, 14–16 and the single track support members 42 and 44. A storage bin 20 is slid in the lower tracks 52 and 53 of the left and right double track support members 46 and 48 until the stops 278 and 268 seat in the respective indentations 276 and 264 of the respective right and left double track support members 48 and 46. When mounted in the lower tracks 52 and 53 of the support members 46 and 48, the left side of the storage bin rim 256 fits snugly in the support member 46 between the rib 257 and the projections 260–262 whereas the right side of the storage bin is free to move laterally within the track 53 of the support member 48 so as to accommodate dimensional variations in the refrigerator compartment liner 24.

Figure 18:
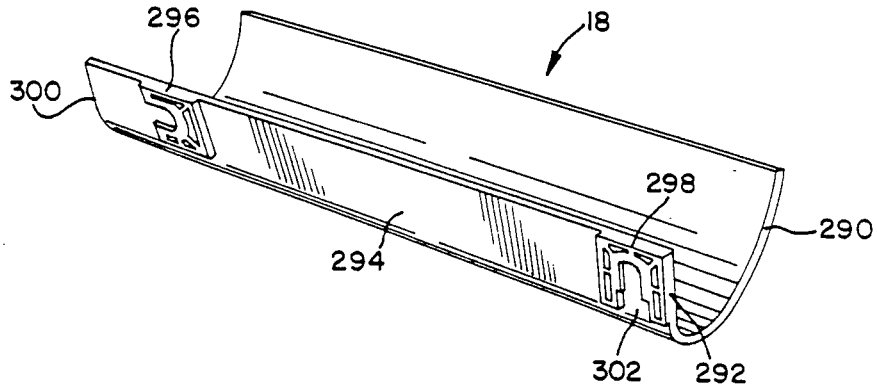
FIG. 18 is a perspective view of a wine rack as shown in FIG. 1.
Figure 16:
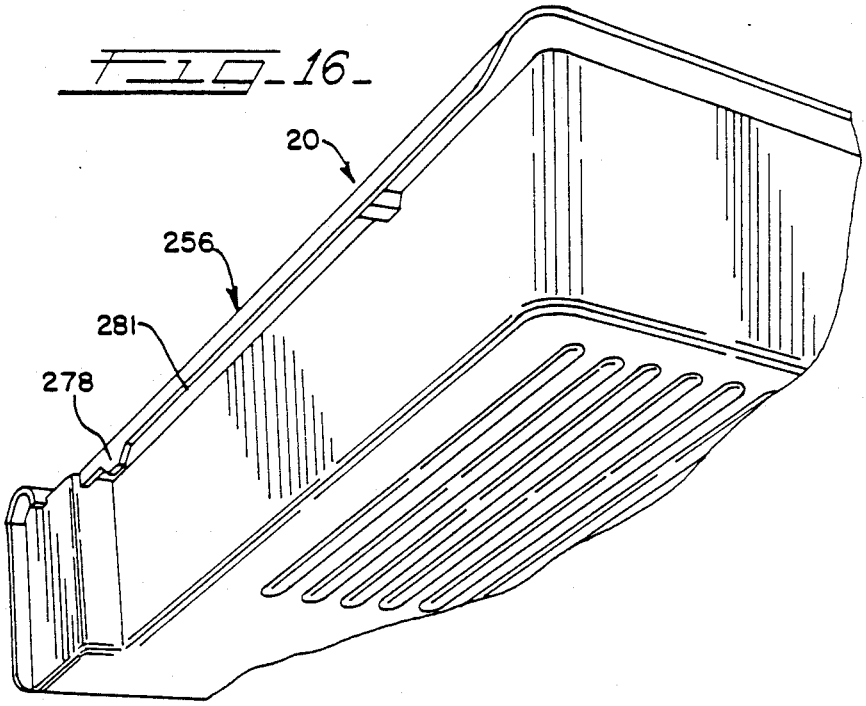
FIG. 16 is a partial perspective view of the right side of the storage bin shown in FIG. 15 as viewed from the rear and beneath the storage bin.
Figure 17:
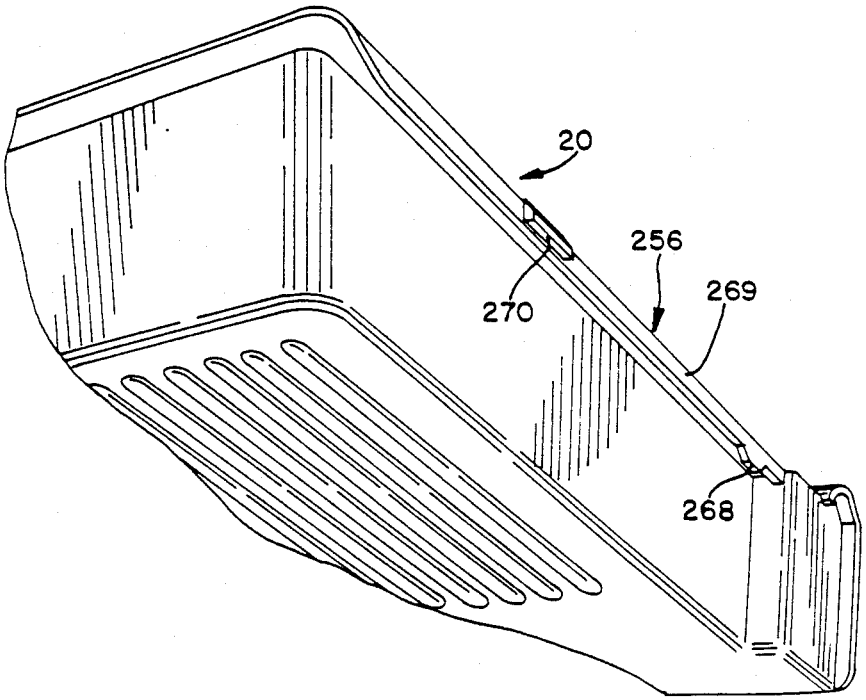
FIG. 17 is a partial perspective view of the left side of the storage bin shown in FIG. 15 as viewed from the rear and beneath the storage bin.

As shown in FIGS. 1 and 18, a wine rack 18 may be mounted in the refrigerator compartment 22 on a pair of studs including a forward stud such as the stud 90 and a rearward stud such as the stud 88. The wine rack 18 includes an elongated bottle support member 290 having a U-shaped cross-section wherein the left side of the bottle support member 290 extends upwardly into an elongated side flange 292. The backside 294 of the side flange 292 of the wine rack 18 includes a rearward slot 296 formed at the rear end of the side flange 292 and further includes a forwardly positioned slot 298 formed at the front end of the flange 292. The rearward slot 296 opens towards the rear 300 of the flange 294 whereas the forwardly positioned slot 298 opens towards the bottom 302 of the flange 294 so that the wine rack 18 may be mounted on a pair of studs 88 and 90 as described for the left single track support member with reference to FIGS. 2 and 3.

Many modifications and variations of the present invention are possible in light of the above teachings. Thus, it is to be understood that, within the scope of the appended claims, the invention may be practiced otherwise than as described hereinabove.

What is claimed and desired to be secured by Letters Patent is:

1. In a refrigerator having a refrigerator compartment with a rear wall and opposed first and second sidewalls, a mounting system for an article supporting member in said refrigerator comprising:

a first pair of horizontally aligned studs mounted on said first sidewall including a rearwardly positioned stud and a forwardly positioned stud;

a first support member having an elongated sidewall with a rearwardly positioned slot and a forwardly positioned slot formed in the backside of said sidewall to respectively engage said rearwardly and forwardly positions studs of said first pair and with an upper flange extending generally horizontally from a front side of said sidewall and a lower flange extending generally horizontally from said front side of said sidewall and spaced a distance below said upper flange to form a first track;

a second pair of horizontally aligned studs mounted on said second sidewall at the same height as said first pair of studs including a rearwardly positioned stud and a forwardly positioned stud;

a second support member having an elongated sidewall with a rearwardly positioned slot and a forwardly positioned slot formed in the backside of said sidewall to respectively engage said rearwardly and forwardly positioned studs of said second pair and with an upper flange extending generally horizontally from a front side of said sidewall and a lower flange extending generally horizontally from said front side of said sidewall and spaced a distance below said upper flange to form a second track, said lower flange including at least one projection extending upwardly from an outer edge thereof; and means for supporting articles thereon, said article supporting means including a frame member extending on opposite sides of said article supporting means, each side of said frame member having a height less than the distance between the upper and lower flanges of said first and second support members so as to be slidably received in a track of a respective support member to mount said article supporting means in said refrigerator compartment, said projection of said second support member engaging the side of said frame member received in said second support member to substantially prevent lateral movement of said frame member in said second support member, said first support member permitting lateral movement of said other side of said frame member to accommodate dimensional variations in said refrigerator compartment.

2. A mounting system for an article supporting member in a refrigerator as recited in claim 1 wherein each of said studs is a dovetail stud and each of said slots is a dovetail slot.

3. A mounting system for an article supporting member in a refrigerator as recited in claim 1 wherein, each of said rearwardly positioned studs has a rounded upper and lower edge so as to permit a support member to rotate about a rearwardly positioned stud when said rearwardly positioned stud is inserted in a rearwardly positioned slot.

4. A mounting system for an article supporting member in a refrigerator as recited in claim 1 wherein each of said rearwardly positioned slots opens towards a rear end of said support member and each of said forwardly positioned slots opens towards a lower edge of the support member to substantially prevent inadvertent disengagement of the support member from said rearwardly and forwardly positioned studs.

5. A mounting system for an article supporting member in a refrigerator as recited in claim 1 wherein each of said slots is generally U-shaped so as to engage a stud on three sides thereof.

6. A mounting system for an article supporting member in a refrigerator as recited in claim 1 wherein the lower flange of said first support member includes an upwardly extending stop projection formed thereon and said article supporting means includes an indentation formed in a bottom surface of the side of said frame member received in said first support member, said indentation receiving said stop projection to prevent said article supporting means from being inadvertently pulled out from said first and second support members.

7. A mounting system for an article supporting member in a refrigerator as recited in claim 1 wherein the lower flange of said second support member includes an upwardly extending stop projection formed thereon and said article supporting means includes an indentation formed in a bottom surface of the side of said frame member received in said second support member, said indentation receiving said stop projection to prevent said article supporting means from being inadvertently pulled out from said first and second support members.

8. A mounting system for an article supporting member in a refrigerator as recited in claim 1 wherein said first support member includes an indentation formed therein and said article supporting means includes a stop projection extending downwardly from a bottom surface of the side of said frame member received in said first support member, said indentation receiving said stop projection to prevent said article supporting means from being inadvertently pulled out from said first and second support members.

9. A mounting system for an article supporting member in a refrigerator as recited in claim 1 wherein said second support member includes an indentation formed therein and said article supporting means includes a stop projection extending downwardly from a bottom surface of the side of said frame member received in said second support member, said indentation receiving said stop projection to prevent said article supporting means from being inadvertently pulled out from said first and second support members.

10. A mounting system for a refrigerator shelf as recited in claim 1 wherein said second support member includes a rib extending from said front side of the sidewall of said second support member between said upper and lower flanges, said rib and projection providing a snug fit for the side of the frame member of the article supporting means received in said second support member.

11. A mounting system for an article supporting member in a refrigerator as recited in claim 1 wherein said article supporting means includes a glass plate for supporting articles thereon and said frame member about opposite sides of the periphery of said plate.

12. A mounting system for an article supporting member in a refrigerator shelf as recited in claim 1 wherein said article supporting means includes a storage bin and said frame member forms a rim extending about the upper surface of at least two opposite sides of said storage bin.

13. In a refrigerator having a refrigerator compartment with a rear wall and opposed first and second sidewalls, a mounting system for an article supporting member in said refrigerator comprising:

a first pair of horizontally aligned studs mounted on said first sidewall including a rearwardly positioned stud and a forwardly positioned stud;

a first support member having an elongated sidewall with a rearwardly positioned slot and a forwardly positioned slot formed in the backside of said sidewall to respectively engage said rearwardly and forwardly positioned studs of said first pair and with a first upper track formed between a pair of elongated upper and lower flanges extending generally horizontally from a front side of said sidewall and a first lower track formed between a pair of elongated upper and lower flanges extending generally horizontally from said front side of said sidewall;

a second pair of horizontally aligned studs mounted on said second sidewall at the same height as said first pair of studs including a rearwardly positioned stud and a forwardly positioned stud;

a second support member having an elongated sidewall with a rearwardly positioned slot and a forwardly positioned slot formed in the backside of said sidewall to respectively engage said rearwardly and forwardly positioned studs of said second pair and with a second upper track formed between a pair of elongated upper and lower flanges extending generally horizontally from a front side of said sidewall and a second lower track formed between a pair of elongated upper and lower flanges extending generally horizontally from said front side of said sidewall, a refrigerator shelf having opposite sides slidably received in said first and second upper tracks; and a storage bin having opposite sides slidably received in said first and second lower tracks.

14. A mounting system for an article supporting member in a refrigerator as recited in claim 13 wherein said lower flange of said second upper track includes at least one projection extending upwardly from an outer edge of said lower flange and said refrigerator shelf includes a frame member extending along the side of said shelf received in said second upper track, said projection abutting an inner surface of said frame member to substantially prevent lateral movement of said frame member in said second upper track.

15. A mounting system as recited in claim 14 wherein said first upper track accommodates lateral movement of the refrigerator shelf side received therein.

16. A mounting system as recited in claim 14 wherein said second upper track includes a rib extending from said front side of the sidewall of said second support member between said upper and lower flanges of said second upper track said rib and projection providing a snug fit for the side of the frame member of said refrigerator shelf received in said second upper track.

17. A mounting system for an article supporting member in a refrigerator as recited in claim 13 wherein said lower flange of said second lower track includes at least one projection extending upwardly from an outer edge of said lower flange and said storage bin includes a frame member extending along the side of said bin received in said second lower track, said projection abutting an inner surface of said frame member to substantially prevent lateral movement of said frame member in said second lower track.

18. A mounting system as recited in claim 17 wherein said first lower track accommodates lateral movement of the refrigerator storage bin side received therein.

19. A mounting system as recited in claim 17 wherein said second lower track includes a rib extending from said front side of the sidewall of said second support member between said upper and lower flanges of said second lower track, said rib and projection providing a snug fit for the side of the frame member of said storage bin received in said second lower track.

20. A mounting system for an article supporting member in a refrigerator as recited in claim 13 wherein each of said studs is a dovetail stud and each of said slots is a dovetail slot.

21. A mounting system for an article supporting member in a refrigerator as recited in claim 13 wherein each of said rearwardly positioned studs has a rounded upper and lower edge so as to permit a support member to rotate about a rearwardly positioned stud when said rearwardly positioned stud is inserted in a rearwardly positioned slot.

22. A mounting system for an article supporting member in a refrigerator as recited in claim 13 wherein each of said rearwardly positioned slots opens towards a rear end of said support member and each of said forwardly positioned slots opens towards a lower edge of the support member to substantially prevent inadvertent disengagement of the support member from said rearwardly and forwardly positioned studs.

23. A mounting system for an article supporting member in a refrigerator as recited in claim 13 wherein each of said slots is generally U-shaped so as to engage a stud on three sides thereof.

24. A mounting system for an article supporting member in a refrigerator as recited in claim 13 wherein the lower flange of said first support member includes an upwardly extending stop projection formed thereon and said article supporting means includes an indentation formed in a bottom surface of the side of said frame member received in said first support member, said indentation receiving said stop projection to prevent said article supporting means from being inadvertently pulled out from said first and second support members.

25. A mounting system for an article supporting member in a refrigerator as recited in claim 13 wherein the lower flange of said second support member includes an upwardly extending stop projection formed thereon and said article supporting means includes an indentation formed in a bottom surface of the side of said frame member received in said second support member, said indentation receiving said stop projection to prevent said article supporting means from being inadvertently pulled out from said first and second support members.

26. A mounting system for an article supporting member in a refrigerator as recited in claim 13 wherein said first support member includes an indentation formed therein and said article supporting means includes a stop projection extending downwardly from a bottom surface of the side of said frame member received in said first support member, said indentation receiving said stop projection to prevent said article supporting means from being inadvertently pulled out from said first and second support members.

27. A mounting system for an article supporting member in a refrigerator as recited in claim 13 wherein said second support member includes an indentation formed therein and said article supporting means includes a stop projection extending downwardly from a bottom surface of the side of said frame member received in said second support member, said indentation receiving said stop projection to prevent said article supporting means from being inadvertently pulled out from said first and second support members.

28. In a refrigerator having a refrigerator compartment with a rear wall and opposed first and second sidewalls, a mounting system for an article supporting member in said refrigerator comprising:

a pair of horizontally aligned studs mounted on said first sidewall including a rearwardly positioned stud and a forwardly positioned stud; and an article supporting member having an elongated side flange with a rearwardly positioned slot and a forwardly positioned slot formed in a backside of said side flange to respectively engage said rearwardly and forwardly positioned studs and having an elongated base member coupled to said side flange and extending outwardly therefrom for supporting an article thereon.

29. A mounting system for an article supporting member in a refrigerator as recited in claim 28 wherein said elongated base member has a generally U-shaped cross-section with one side of said elongated base member extending downwardly from said side flange to support a bottle lengthwise therein.

30. A mounting system for an article supporting member in a refrigerator as recited in claim 28 wherein said side flange and base member are integrally formed.

31. A mounting system for an article supporting member in a refrigerator as recited in claim 28 wherein each of said studs is a dovetail stud and each of said slots is a dovetail slot.

32. A mounting system for an article supporting member in a refrigerator as recited in claim 28 wherein each of said rearwardly positioned studs has a rounded upper and lower edge so as to permit said article supporting member to rotate about a rearwardly positioned stud when said rearwardly positioned stud is inserted in a rearwardly positioned slot.

33. A mounting system for an article supporting member in a refrigerator as recited in claim 28 wherein each of said rearwardly positioned slots opens towards a rear end of said side flange and each of said forwardly positioned slots opens towards a lower edge of the side flange to substantially prevent inadvertent disengagement of the article supporting member from said rearwardly and forwardly positioned studs.

34. A mounting system for an article supporting member in a refrigerator as recited in claim 28 wherein each of said slots is generally U-shaped so as to engage a stud on three sides thereof.

* * * * *